US007794027B2

(12) United States Patent
Calabria et al.

(10) Patent No.: US 7,794,027 B2
(45) Date of Patent: Sep. 14, 2010

(54) STORAGE BIN WITH LIFTING MECHANISM

(75) Inventors: Melanie Calabria, Columbia, MD (US); Joseph Edward Jasinski, Raleigh, NC (US); Kevin Owen Roughton, Saco, ME (US); Sherry Eckholm, Watertown, WI (US); Brian Joseph Wismann, Talent, OR (US); William Myles Riley, Richmond, VA (US); Bruce Seymour Ferris, Richmond, VA (US); Paul Gilbert Rockwell, Chesterfield, VA (US)

(73) Assignee: Newell Operating Company, Atlanta, GA (US)

( * ) Notice: Subject to any disclaimer, the term of this patent is extended or adjusted under 35 U.S.C. 154(b) by 970 days.

(21) Appl. No.: 11/429,409

(22) Filed: May 5, 2006

(65) Prior Publication Data

US 2007/0018545 A1 Jan. 25, 2007

Related U.S. Application Data

(60) Provisional application No. 60/678,651, filed on May 6, 2005.

(51) Int. Cl.
*A47B 57/00* (2006.01)

(52) U.S. Cl. ..... 312/311; 312/312

(58) Field of Classification Search ..... 312/311, 312/312, 319.5, 334.1, 334.4, 295, 310, 319.1, 312/24, 27, 28, 317.1, 317.2, 317.3, 319.2; 211/79, 80, 81, 82; 74/469; 248/157, 188.6, 248/419, 420, 423; 414/11, 331.11, 465
See application file for complete search history.

(56) References Cited

U.S. PATENT DOCUMENTS

| | | | | | |
|---|---|---|---|---|---|
| 806,790 | A | * | 12/1905 | Foersterling | 248/281.11 |
| 1,965,370 | A | * | 7/1934 | Cohn | 5/10.2 |
| 2,543,485 | A | * | 2/1951 | Briggs | 312/27 |
| 2,643,167 | A | | 6/1953 | Wade | |
| 2,822,229 | A | * | 2/1958 | Carlson | 312/27 |
| 2,859,083 | A | * | 11/1958 | Devlin et al. | 312/298 |
| 2,919,966 | A | | 1/1960 | Preston | |

(Continued)

OTHER PUBLICATIONS

Amerock: Organizers Hide-A-Shelf Hardware Kit, p. 35 available to Applicant at least as early as Apr. 2006 date of actual publication unknown.

Rev-A-Shelf; Heavy Duty Mixer Lift (one page) available to Applicant at least as early as Mar. 3, 2005 date of actual publication unknown.

*Primary Examiner*—Darnell M Jayne
*Assistant Examiner*—Michael Calabrese
(74) *Attorney, Agent, or Firm*—Taft Stettinius & Hollister LLP

(57) ABSTRACT

A lifting mechanism for a storage bin is positioned in a cabinet having a countertop. The lifting mechanism has a base adapted to be supported in the cabinet, a moveable member operably connected to the base, a support member connected to the moveable member, and a storage bin supported by the support member. The moveable member is moveable between a first position, wherein the storage bin is adapted to be positioned within the cabinet, and a second position wherein the storage bin is raised such that the storage bin is adapted to be positioned out of the cabinet. When the storage bin is raised, a top of the storage bin is adapted to be positioned proximate the countertop.

16 Claims, 12 Drawing Sheets

U.S. PATENT DOCUMENTS 3,114,459 A 12/1963 Kersting
3,490,727 A * 1/1970 Miller ..... 248/284.1
D243,042 S 1/1977 Dorn
4,002,240 A 1/1977 Dorn
D264,761 S 6/1982 Dekarski
D280,788 S 10/1985 Levin
4,569,447 A 2/1986 Cifranie
4,893,885 A 1/1990 Borello
5,108,063 A * 4/1992 Koerber et al. ..... 248/284.1
D326,946 S 6/1992 Szuster
5,222,790 A * 6/1993 Latino ..... 312/315
5,249,533 A * 10/1993 Moore, III ..... 108/69
5,308,158 A * 5/1994 Vogelgesang et al. .... 312/319.3
D360,559 S 7/1995 Grubb et al.
5,437,376 A 8/1995 Larsen
5,447,146 A * 9/1995 Nickerson ..... 126/339
5,484,127 A * 1/1996 Mower et al. ..... 248/284.1
5,586,816 A 12/1996 Geiss, II
5,634,529 A * 6/1997 Nguyen et al. ..... 182/113
D416,169 S 11/1999 Sarnoff et al.
6,161,808 A 12/2000 East et al.
6,241,123 B1 * 6/2001 Elmore ..... 222/129
6,247,771 B1 * 6/2001 Miller ..... 312/310
6,520,354 B1 2/2003 Skvorecz
6,595,475 B2 7/2003 Svabek et al.
6,659,576 B1 * 12/2003 Welch ..... 312/334.41
D485,706 S 1/2004 O'Connell Cooper et al.
D486,008 S 2/2004 Pospisil et al.
6,702,411 B2 3/2004 Helver
D514,354 S 2/2006 Nix et al.
7,396,093 B2 * 7/2008 Jeong et al. ..... 312/402
2001/0024984 A1 * 9/2001 Stanford et al. ..... 473/484
2003/0034318 A1 2/2003 Skvorecz
2004/0066121 A1 4/2004 Steadman
2005/0006994 A1 * 1/2005 Rapier, III ..... 312/311
2005/0023230 A1 2/2005 Lin
2005/0206282 A1 * 9/2005 Walburn ..... 312/312
2005/0218274 A1 10/2005 Skvorecz
2006/0066189 A1 * 3/2006 Bond et al. ..... 312/319.1
2008/0129168 A1 * 6/2008 Banta et al. ..... 312/333

* cited by examiner

STORAGE BIN WITH LIFTING MECHANISM

CROSS-REFERENCE TO RELATED APPLICATIONS

The present application claims priority to and the benefit of U.S. Provisional Application No. 60/678,651, filed on May 6, 2005, and is incorporated by reference and made a part hereof.

TECHNICAL FIELD

The invention relates to storage bins, such as a kitchen wastebasket and, more particularly, to a storage bin having a lifting mechanism to lift the storage bin to a raised position, and to maintain the storage bin in the raised position.

BACKGROUND OF THE INVENTION

Items such as garbage containers or other storage containers that are installed in lower cabinets, such as kitchen cabinets, typically require a user to bend over to access the container and do not offer the user the option to raise the container up to a more comfortable height. Storage and organizational containers that are installed in the cabinet are also typically not released from their topmost level and lowered back into the cabinet. Storage and organizational containers that are installed in the cabinet typically are unable to perform more that one motion, i.e., being able to be pulled out as well as raised up.

In order to withstand the weight of the items, storage and organizational items that are typically available today and which are able to be lifted to countertop height must be adjusted manually to counter balance the weight. Similar storage and organizational items that raise up to countertop height are typically not functional when not raised up to countertop height, and not easily installed by an end consumer, as they are typically too complicated to be installed by anyone other than a custom kitchen designer or OEM.

Shelving units that create additional workspace by concealing the shelving unit inside a cabinet are also known. Many of these shelving units are adapted to be lifted up to countertop height. Some shelving units are directed specifically to placing an appliance on a lift allowing a user to store appliances inside a cabinet, and lift them to countertop height when in use. These shelving units are commonly known to be unable to perform more than a single motion (i.e. being able to be pulled out as well as raised up). In addition, shelving units that can be lifted out of a cabinet are difficult to release once they are in a raised position. In some shelving units with a lift, in order to withstand the weight of certain items that are lifted to the countertop, the lift must be manually adjusted to counter balance the weight. These shelving units are complex and difficult to mount by a consumer in a cabinet without additional professional assistance.

While storage, organizational, and shelving units according to the prior art provide a number of advantageous features, they nevertheless have certain limitations. The present invention is provided to solve the problems discussed above and other problems, and to provide advantages and aspects not provided by prior units of this type. A full discussion of the features and advantages of the present invention is deferred to the following detailed description, which proceeds with reference to the accompanying drawings.

SUMMARY OF THE INVENTION

The present invention provides for a lifting mechanism in a cabinet with a countertop. The lifting mechanism can lift various items from the cabinet such as storage bins, organizational units, appliances or other items.

According to a first aspect of the invention, the lifting mechanism has a base adapted to be supported in the cabinet, a moveable member connected to the base, a support member connected to the moveable member, and a storage bin supported by the support member. In one preferred embodiment, the moveable member is moveable between a first position, in which the storage bin is positioned within the cabinet, and a second position in which the storage bin is raised and positioned out of the cabinet. The storage bin is adapted to be positioned proximate the countertop when the storage bin is out of the cabinet in the raised position.

According to another aspect of the invention, a lifting mechanism is provided for a storage bin in a cabinet having a countertop. The lifting mechanism has a sliding mechanism adapted to be connected to a floor of the cabinet. The sliding mechanism is moveable between a retracted position and an extended position. A base is connected to the sliding mechanism, the base having a slot having a generally vertical portion and a generally horizontal portion. A moveable member is moveable between a lowered position and a raised position. The moveable member has an arm having a first end and a second end, the first end of the arm pivotally connected to the base. The moveable member further has a link having a first end pivotally connected to the arm and a second end slideable in the slot. A support member is connected to the second end of the arm and has a plurality of rails cooperatively defining an opening adapted to receive the storage bin through the opening.

According to a further aspect of the invention, when the sliding mechanism is in the retracted position, the support member is adapted to be positioned within the cabinet, and wherein when the sliding mechanism is in the extended position, the support member is adapted to positioned out of the cabinet. As the arm moves from the lowered position, the link slides along the vertical portion of the slot and into the horizontal portion of the slot to define a latched position. The arm is in the raised position of the moveable member placing the support member in a raised position, such that a top of the storage bin adapted to be supported by the support member is adapted to be positioned proximate the countertop.

According to another aspect of the invention, a spring is connected to the base. The spring engages the link to bias the link into the horizontal portion of the slot.

According to a further aspect of the invention, a cylinder has a first end connected to the base and a second end connected to the moveable member. The cylinder dampens movement of the moveable member from the raised position to the lowered position.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
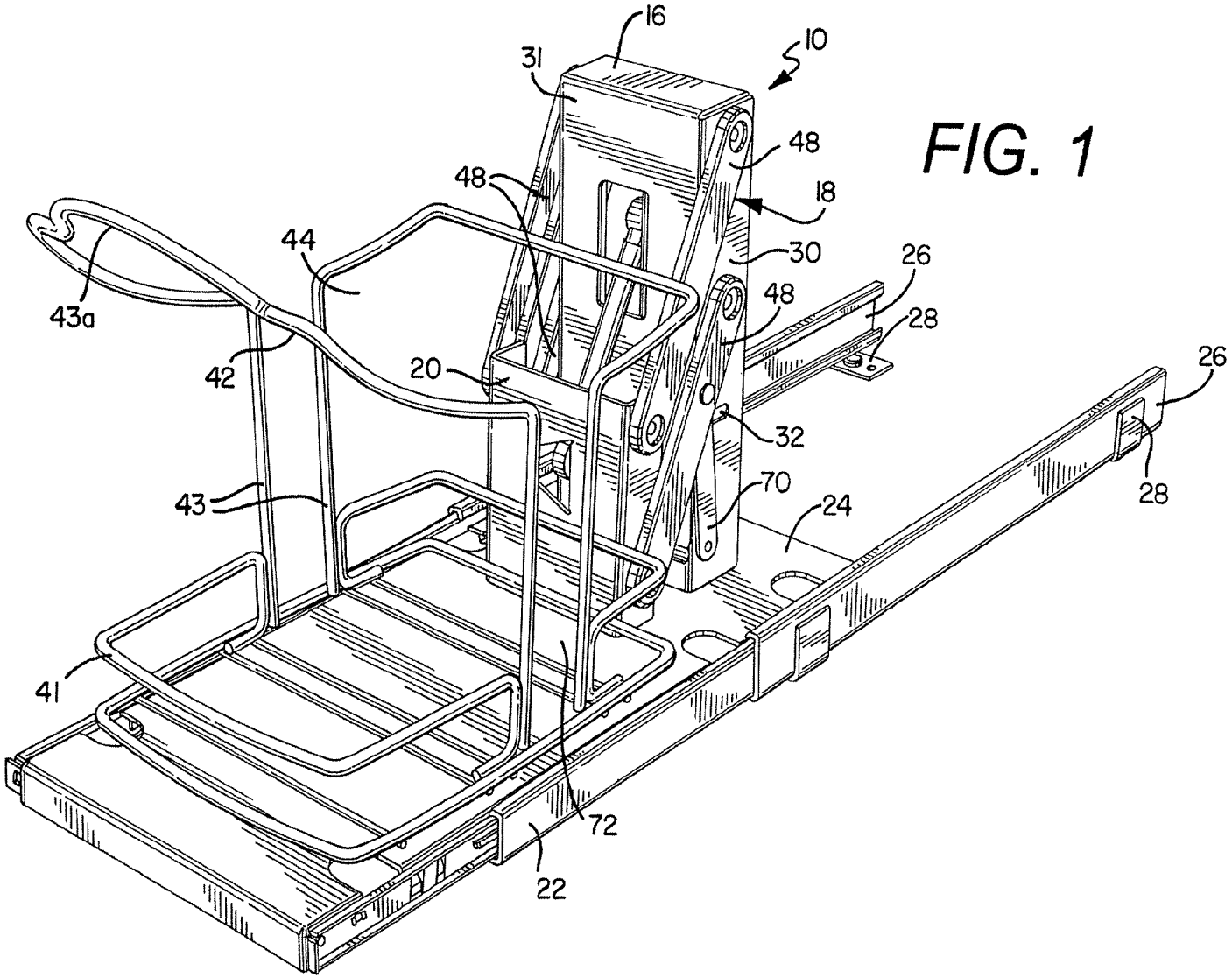
FIG. 1 is a perspective view of a lifting mechanism for a storage bin in accordance with the present invention.
Figure 3:
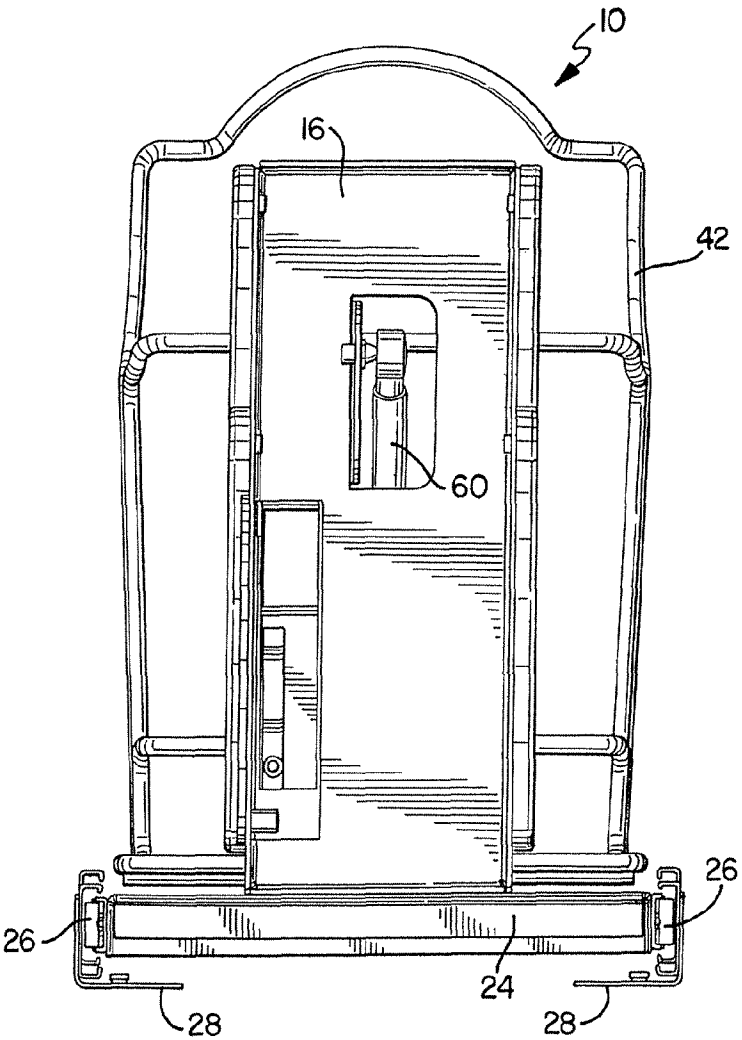
FIG. 3 is a rear view of the lifting mechanism of FIG. 1.
Figure 2:
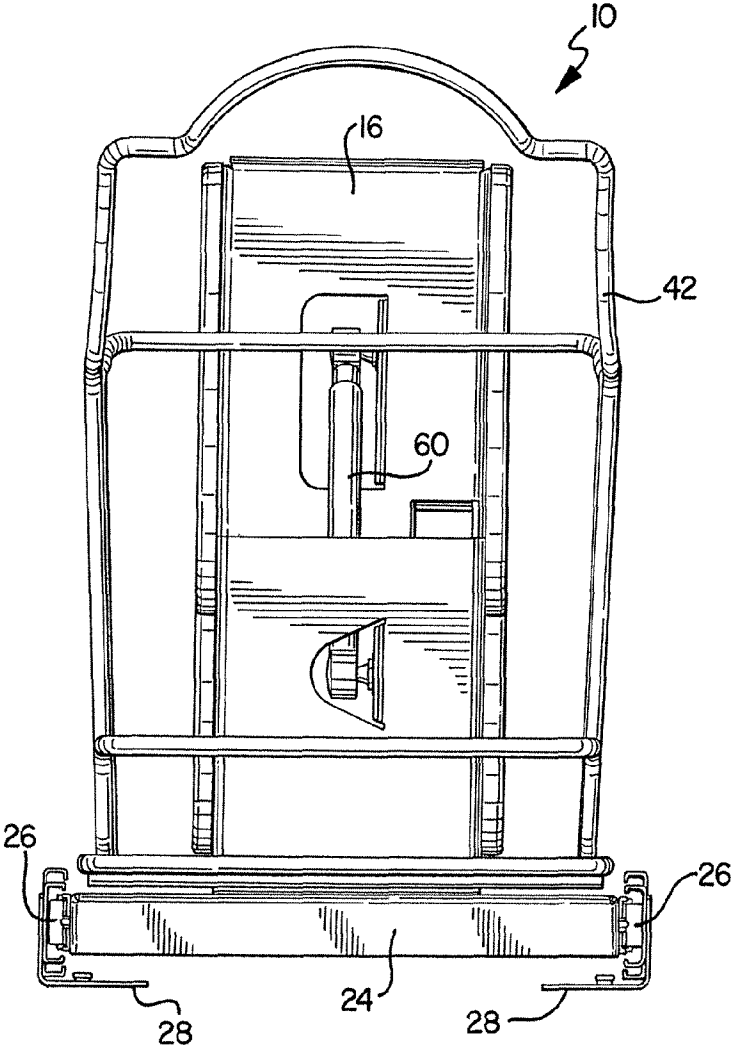
FIG. 2 is a front view of the lifting mechanism of FIG. 1.
Figure 4:
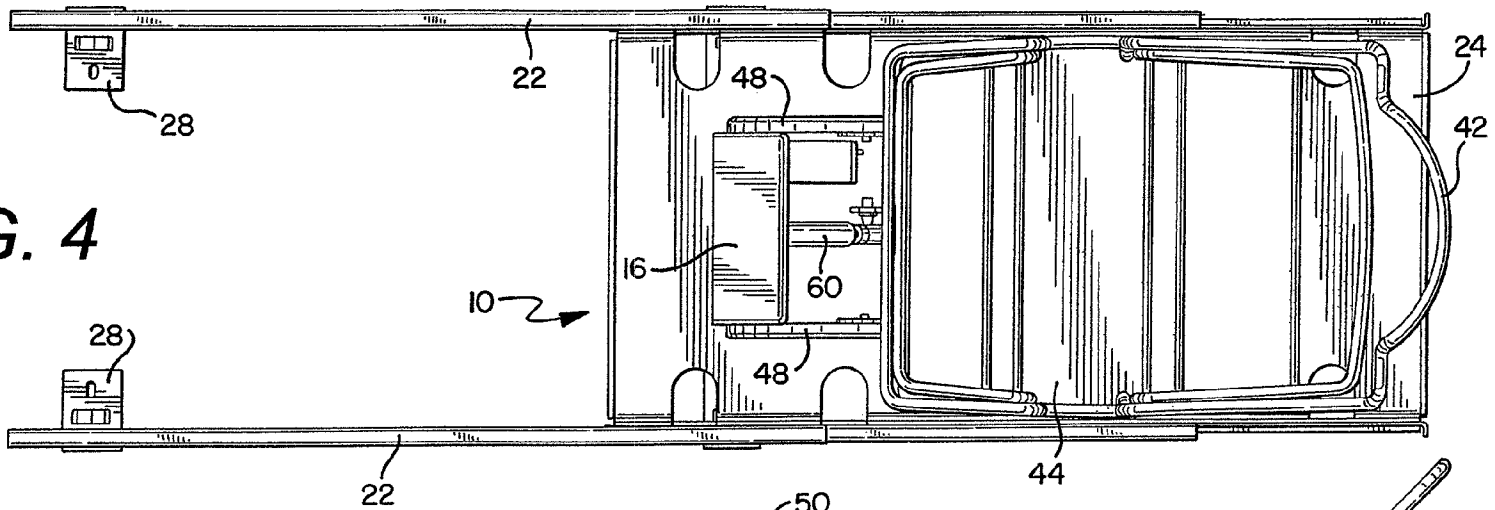
FIG. 4 is a top plan view of the lifting mechanism of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-16 show the lifting mechanism of the present invention, generally designated with reference numeral 10, used in a cabinet 12 having a countertop 14. The lifting mechanism 10 is designed to lift an item such as a storage bin from a stored position in the cabinet 12. In one preferred embodiment, the storage bin is a wastebasket.

As shown in FIGS. 1 and 8-10, the lifting mechanism generally has a base 16, a moveable member 18, a support member 20, and a sliding mechanism 22. FIG. 1 shows the base 16 of the lifting mechanism 10 supported on a carrier 24 used to connect the base 16 to the sliding mechanism 22. The carrier 24 serves as a platform for the base 16, and is mounted in the cabinet 12 via the sliding mechanism 22. The sliding mechanism 22 has a plurality of telescoping horizontal rails 26 that receive the carrier 24. As shown in FIGS. 2-6, the rails 26 of the sliding mechanism 22 include tabs 28 that allow the sliding mechanism 22 to be easily secured to the floor of the cabinet 12 by suitable fasteners. It is contemplated that the sliding mechanism 22 could also be configured to be mounted to other portions of the interior of the cabinet such as the walls of the cabinet. The sliding mechanism 22 allows the carrier 24 to move horizontally between an extended position and a retracted position. One of the benefits of the present invention is the ability for the lifting mechanism to be functional in various different positions as will be discussed below.

Figure 7:
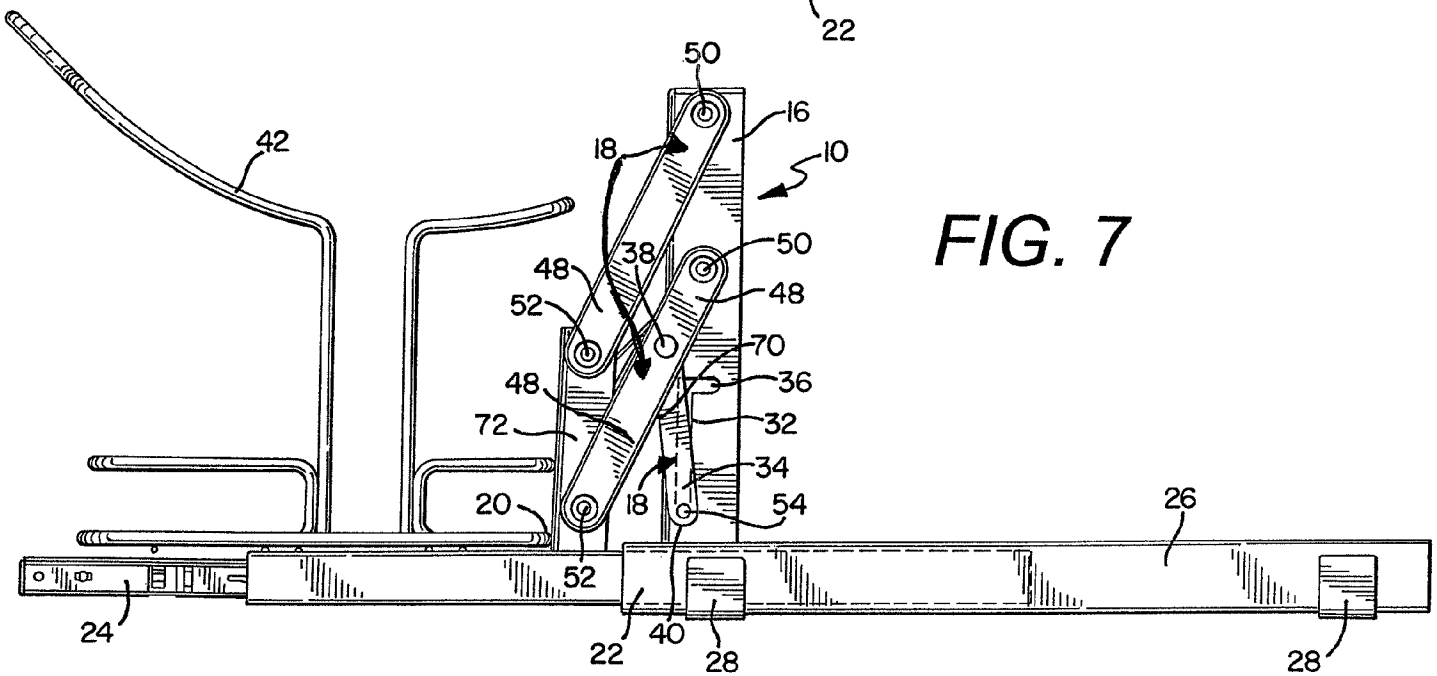
FIG. 7 is a right side elevation view of the lifting mechanism of FIG. 1.
Figure 9:
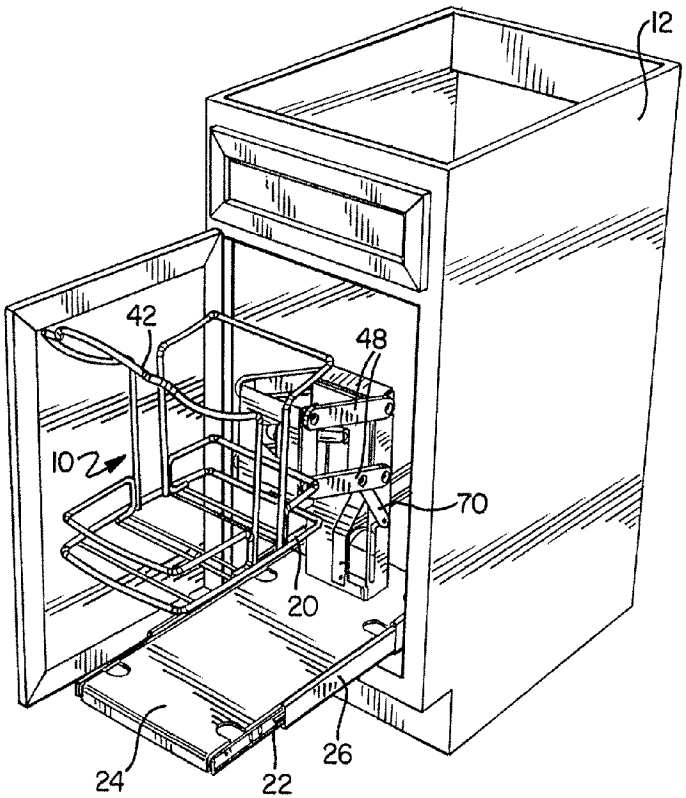
FIG. 9 is a perspective view of the lifting mechanism of FIG. 1, shown installed in a cabinet in a raised position.
Figure 10:
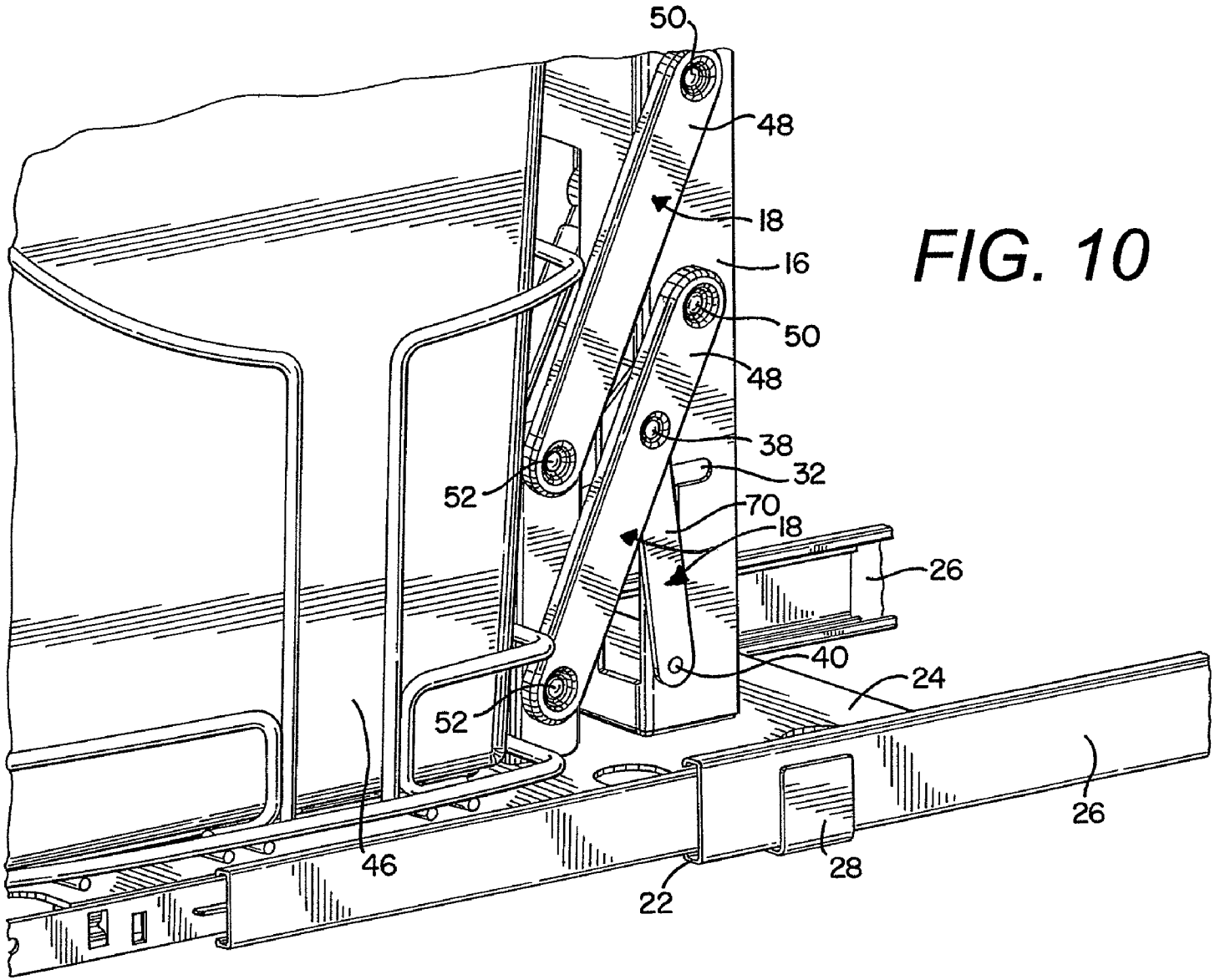
FIG. 10 is a partial enlarged perspective view of a base of the lifting mechanism with a storage bin a lowered position.
Figure 11:
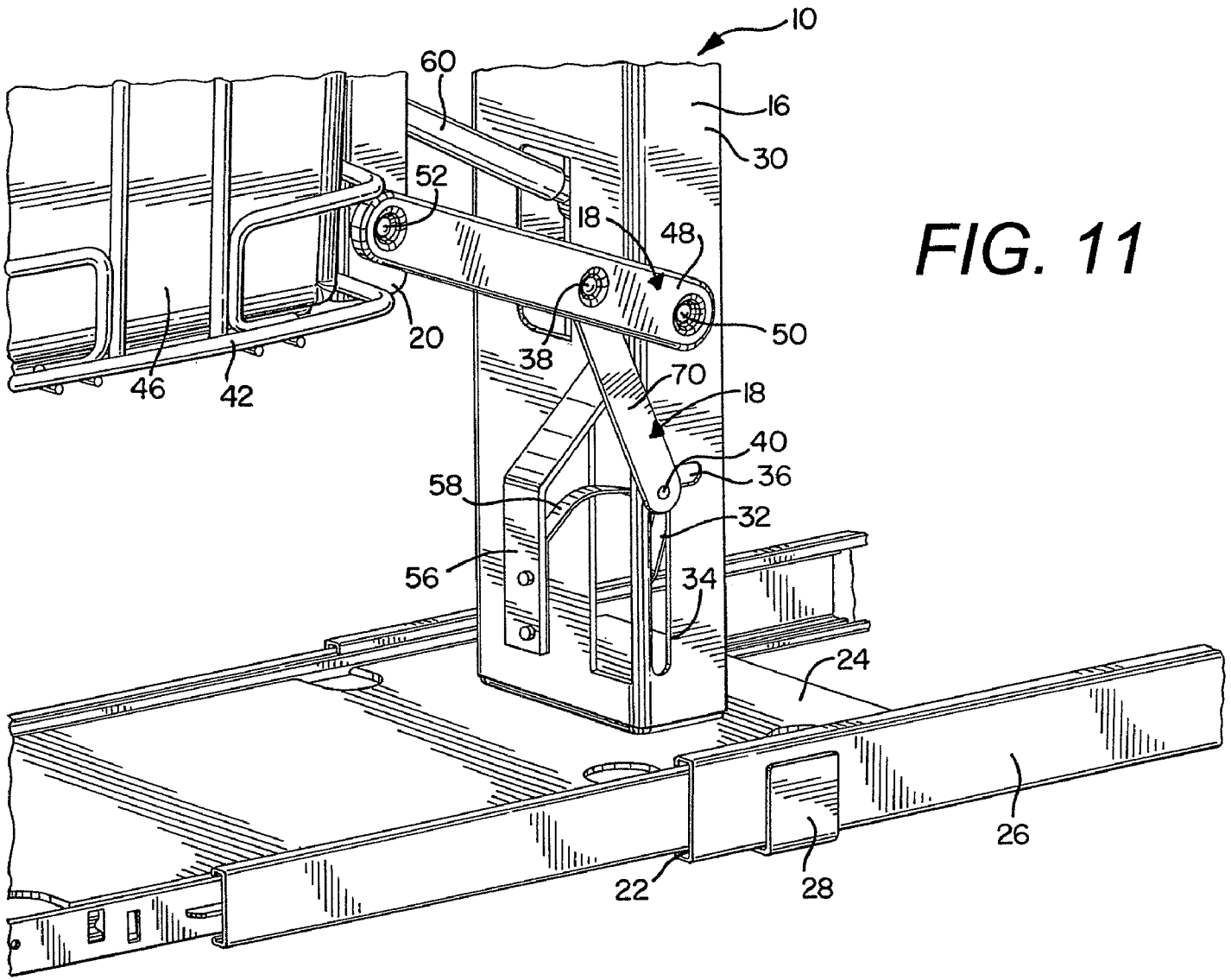
FIG. 11 is a partial enlarged perspective view of the base of FIG. 10, with the storage bin in a raised unlatched position.

FIGS. 1 and 7 show the base 16 of the lifting mechanism 10. As discussed above, the base 16 is mounted on the carrier 24. It is understood that the base 16 could be directly in the cabinet 12 or connected to the sliding mechanism 22 in other forms. In one preferred embodiment, the base 16 is mounted so it is substantially perpendicular to the carrier 24. The configuration of the base 16 may vary depending on the dimensions of the cabinet 12. As shown in FIGS. 1, 10, and 11, the base 16 has a set of sidewalls 30. The sidewalls 30 are connected by a cross-member 31. One sidewall 30 includes a slot 32 for receiving a portion of the moveable member 18, which is discussed in greater detail below. In one preferred embodiment, the slot 32 has a substantially L-shape. Thus, the slot 32 has a generally vertical portion 34 and a generally horizontal portion 36. The base 16 further has a depending bracket that supports a spring to be described in greater detail below. It is understood that the slot 34 could be positioned on either sidewall 30 or both.

FIGS. 1, 7, and 9-14 show the moveable member 18. The moveable member 18 is operably connected to the base 16 and generally has a lowered position and a raised position. The moveable member generally includes an arm 48 and a link 70. As shown in FIGS. 10-14 the arm 48 is elongated and pivotally connected to the base 16 at a connection point 50. The other end of the arm 48 is connected to the support member at a connection point 52. As will be discussed in greater detail below, the moveable member 18 operates to raise and lower the support member 20.

In a preferred embodiment, the moveable member 18 has a plurality of arms 48. In one preferred embodiment, the lifting mechanism 10 has two arms 48 on each sidewall 30. Each arm 48 is pivotally connected to the base 16. Additionally, each arm 48 is operably connected to the support member 20. In one preferred embodiment, a plate 72 extends between the arms 48 and serves as an interface for connection to the support member 20. As will be understood from the drawings, the arms 48 are pivotally connected at the plate 72. The support member 20 is connected to the plate 72 wherein the plate 72 remains in a vertical configuration as the moveable member 18 moves between the lowered position and the raised position. Accordingly, the storage bin 46 also remains in a vertical configuration during movement. In one preferred embodiment, the plate is considered a portion of the moveable member. It is understood that the support member 20 could be connected directly to the arms 48, omitting the plate 72. It is also understood that the plate 72 or other suitable mounting members, could be considered a portion of the support member 20.

The moveable member 18 also has a link 70. The link 70 has one end that is pivotally connected to an arm 48 at connection point 38. The other end of the link 70 has a pin 54 that is positioned in the slot 32 at point 40. While arms 48 and the link 70 are preferred, the moveable member can take other forms.

Figure 5:
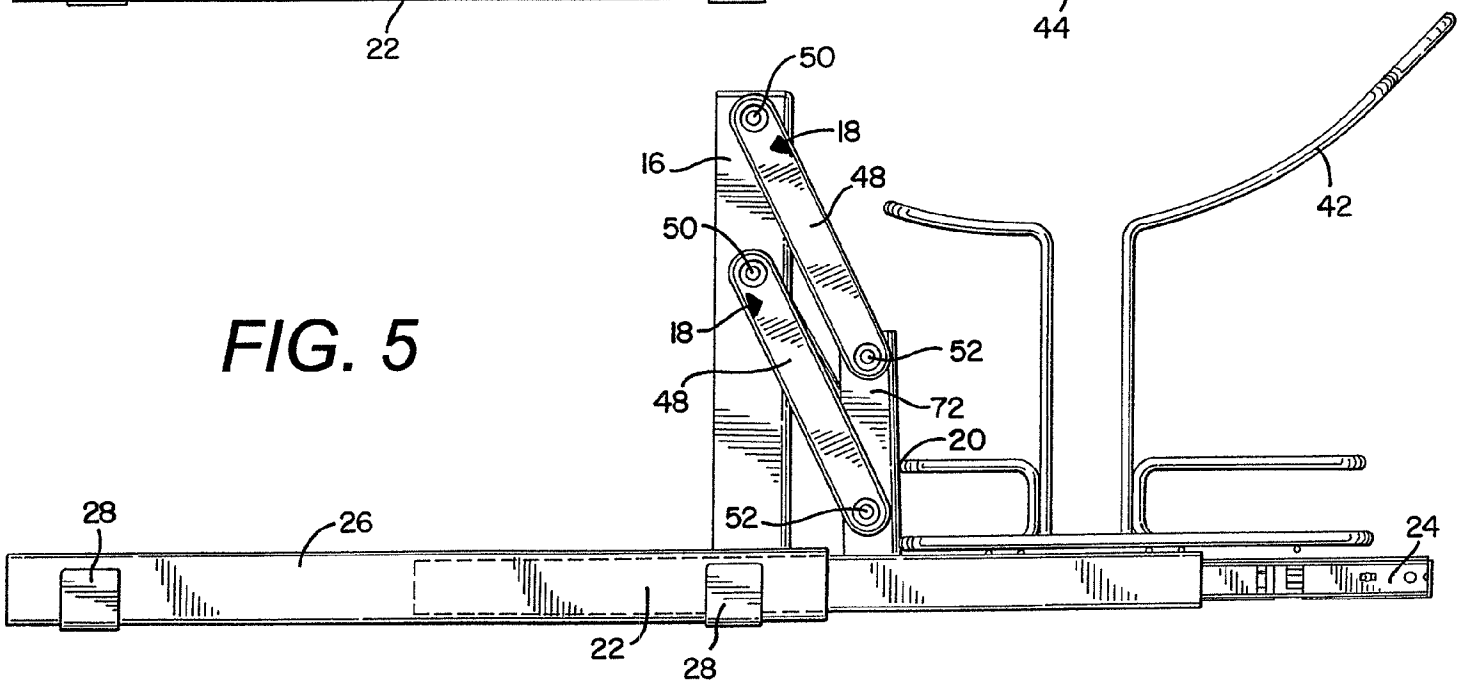
FIG. 5 is a left side elevation view of the lifting mechanism of FIG. 1.
Figure 6:
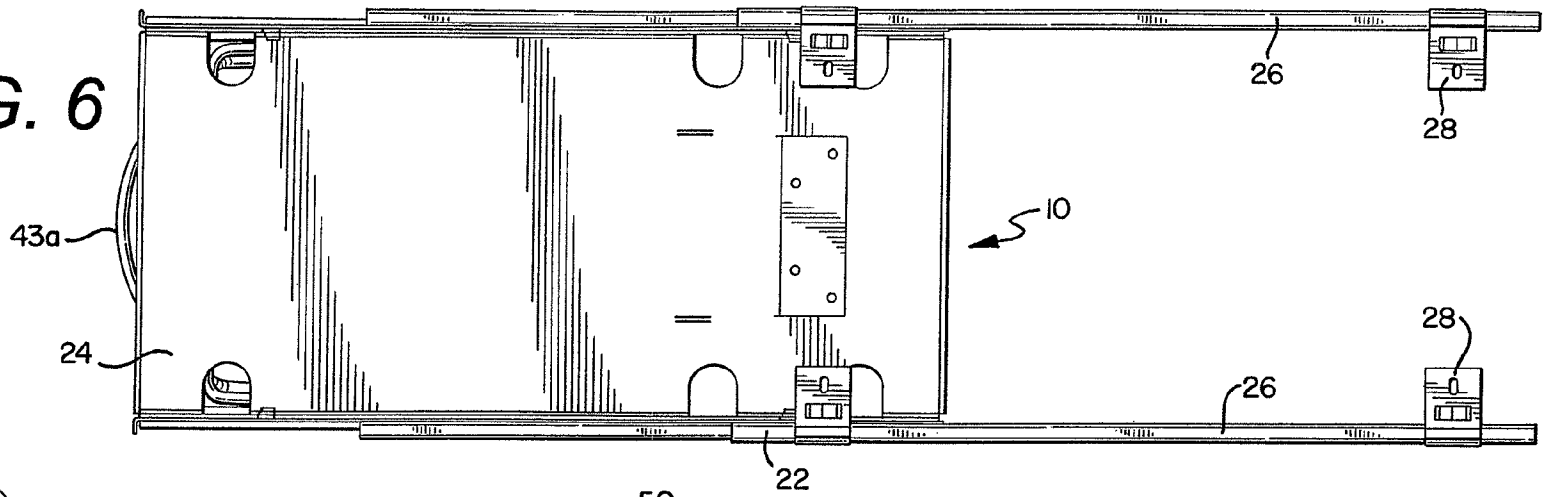
FIG. 6 is a bottom plan view of the lifting mechanism of FIG. 1.

Referring to FIGS. 1, 5, and 7, the lifting mechanism 10 has a support member 20. In one preferred embodiment, the support member 20 has a plurality of rails 42 that cooperatively define an opening 44. The opening 44 of the support member 20 is configured to receive the storage bin or wastebasket 46. The rails 42 include lower rails 41 and a pair of upwardly extending rails 43. A front upwardly extending rail 43 forms a handle 43*a*. The rails 42 cooperatively contain and support the storage bin 46. Although FIG. 1 shows the support member 20 comprising a plurality of rails 42, it is contemplated that the support member 20 could take on any formation that secures a wastebasket or storage bin, such as a basket or cradle.

Figure 14:
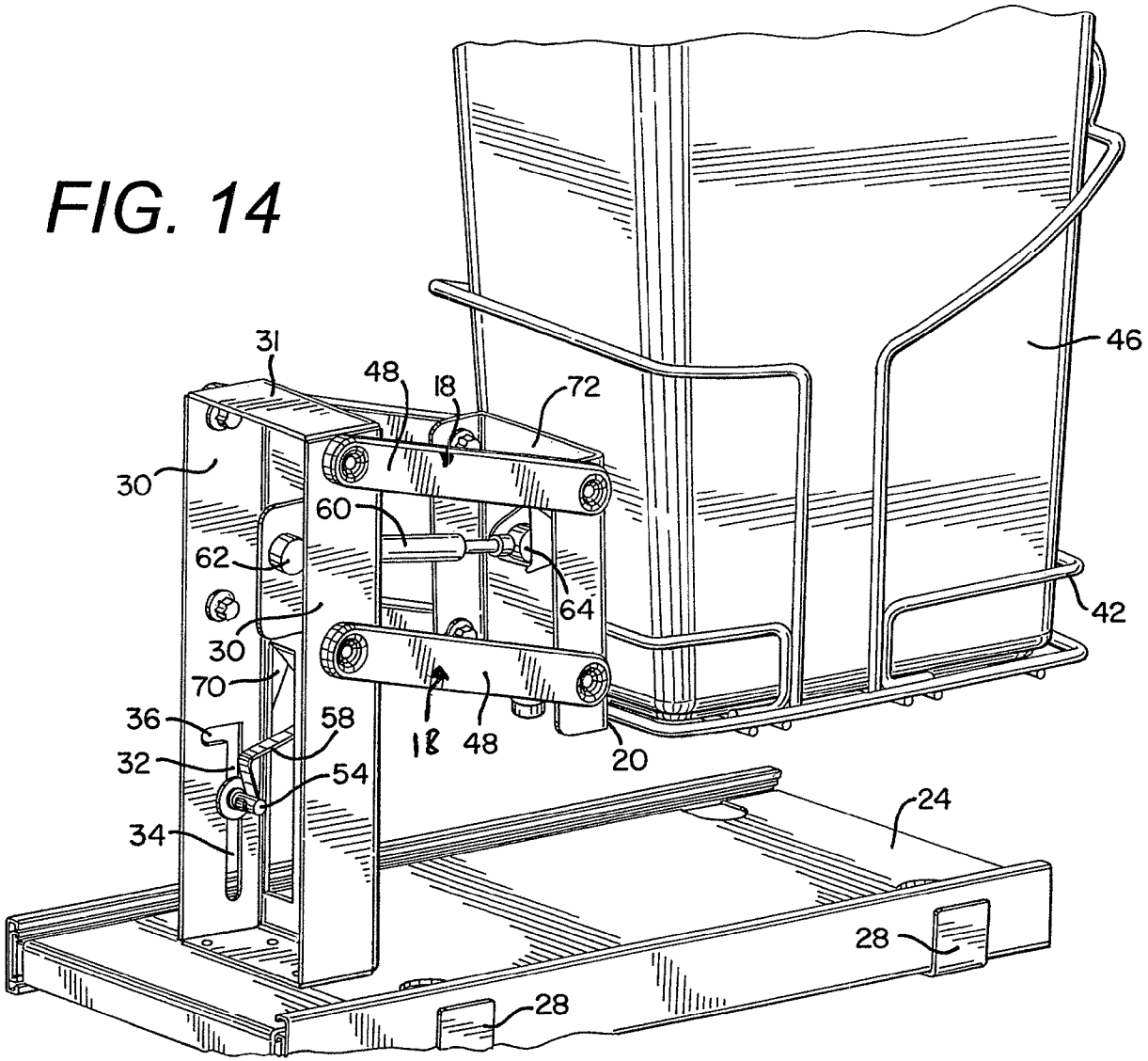
FIG. 14 is a partial enlarged perspective view of the base of FIG. 10, with the storage bin in a mid-position.

FIG. 14 shows a cylinder 60 that has a first end 62 connected to the base 16 and a second end 64 that is connected to the support member 20. In a preferred embodiment, the cross-member 31 has an opening and the first end 62 of the cylinder 60 is connected to a bracket 56 associated with the cross-member 31. The second end 64 of the cylinder 60 extends from the first end 62 and is connected to a bracket associated with the plate 72. It is understood that the second end 64 of the cylinder 60 could be connected to other portions of the moveable member 18 such as the arms 48. The cylinder 60 functions to dampen the movement of the support member 20 by easing movements from a raised position, and vice versa. As discussed, the cylinder 60 enhances the lowering movement of the lifting mechanism 10. The cylinder 60 dampens movement of the moveable member 18 and therefore support member 20 and storage bin 46. Accordingly, the storage bin 46 is lowered in a controlled fashion that is more desirable to the user. The cylinder 60 can also enhance controlled movement of the moveable member 18 from the lowered position to the raised position. The cylinder 60 could be connected to other portions of the lifting mechanism 10 to suitably dampen movement.

Figure 12:
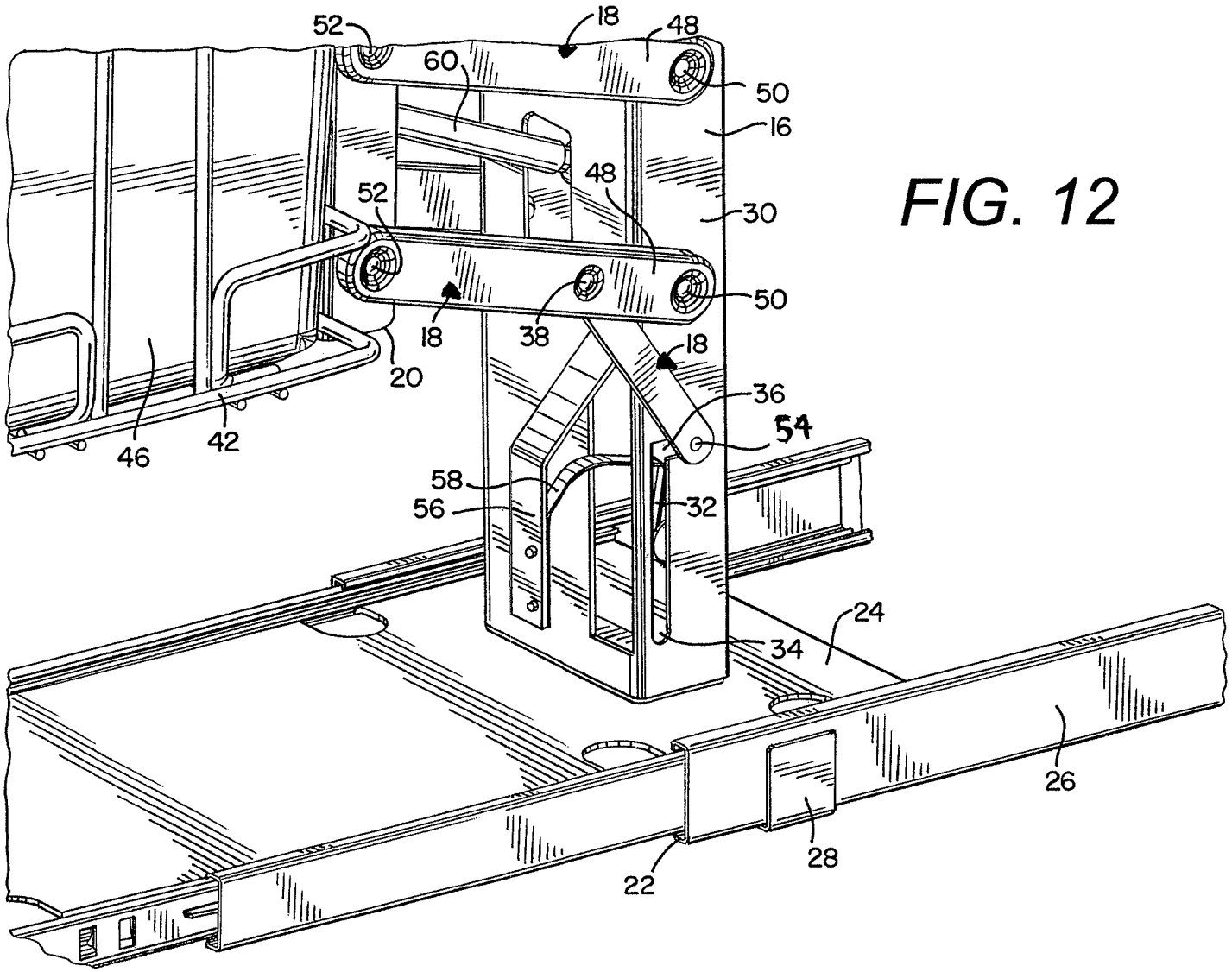
FIG. 12 is a partial enlarged perspective view of the base of FIG. 10, with the storage bin in a raised and latched position.
Figure 13:
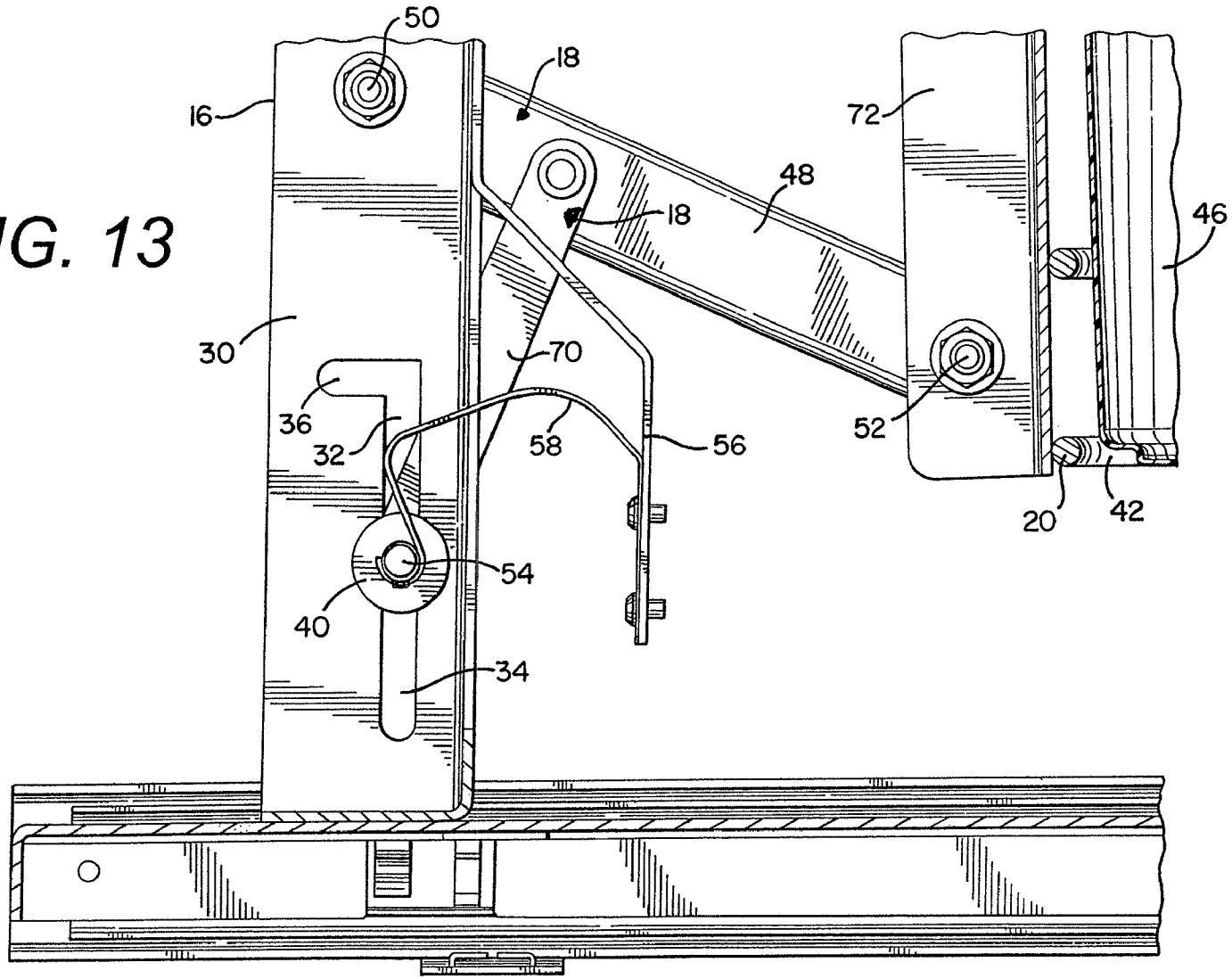
FIG. 13 is a partial enlarged side elevation of the base of FIG. 10, with the storage bin in a mid-position.

FIGS. 1, 5, and 7 show the support member 20 connected the moveable member 18. In one preferred embodiment, the support member 20 is connected to the base 16 by the moveable member 18, and more specifically by the arms 48 via the plate 72. It is within the scope of this invention that the number of arms 48 connecting the support member 20 to the base 16 may vary depending on the necessary support. For instance, a user may require additional support if they plan to place heavy items in the storage bin or wastebasket. As shown in FIGS. 12-13, first ends of the arms 48 are pivotally connected to the base 16 at connection point 50, and the second ends of the arms 48 are pivotally connected to the plate 72 at connection point 52. The plate 72 is then connected to the support member 20. As mentioned above, the moveable member 18 also has the link 70. The link 70 has a first end that is pivotally connected to an arm 48 at point 38. The second end of the link 70 has the pin 54 that is positioned in the slot 32 at point 40. The pin 54 extends from one end of the link 70 and through the slot 32. The pin 54 operates to secure the link 70 in the slot, and further assists movement of the link 70 to follow the configuration of the slot 32. For example, it is contemplated that the slot could take on an S-shape or Z-shape configuration, which would ultimately affect the resulting positions of the lifting mechanism 10.

FIGS. 11-13 show the base 16 also having a bracket 56 attached to one of the faces of the base 16. The bracket 56 is also attached to a spring 58 that operates to bias the pin 54 horizontal portion 36 of the slot 32 to be described in greater detail below. The spring 58 has a generally curvy linear configuration and an angled tab at a distal end. In one preferred embodiment, the spring 58 may be made of a spring temper strip or spring temper wire.

FIGS. 8-16 show the lifting mechanism 10 in operation. In use, one of the benefits of the present invention is that it allows a user the option of using the storage bin 46 when the lifting mechanism 10 is in the extended position or when it is in the raised position. When the lifting mechanism 10 is not in use, it can be stored in a retracted position completely within the cabinet 12. This allows a user to conceal the storage bin 46 and create additional workspace. Thus, the sliding mechanism 22 is in the retracted position and the moveable member 18 is in the lowered position wherein the support member 20, and therefore the storage bin 46 is positioned in the cabinet. When a user is ready to use the storage bin 46, the lifting mechanism 10 can then be placed in a position in which a user pulls the storage bin 46 directly out of the cabinet 12 along a horizontal axis by pulling the handle 43*a*. Due to the sliding mechanism 22, which is mounted into the cabinet 12, the carrier 24 that supports the base 16, the moveable member 18, and the support member 20, are able to slide in and out of the cabinet along the horizontal rails 26 in a linear manner via the telescoping rails of the sliding mechanism 22. When the support member 20 is completely in the cabinet 12, the sliding mechanism 22 is in the retracted position, and when the support member 20 is outside the cabinet 12, the sliding mechanism 22 is in the extended position. A user has the option of using the storage bin 46 when it is in the extended position. As mentioned above, one of the benefits of the present invention is that a user has the option of using the storage bin 46 in either an extended position, in which the storage bin 46 is not at countertop height, or in a raised positioned, in which the storage bin 46 is at countertop height.

Figure 8:
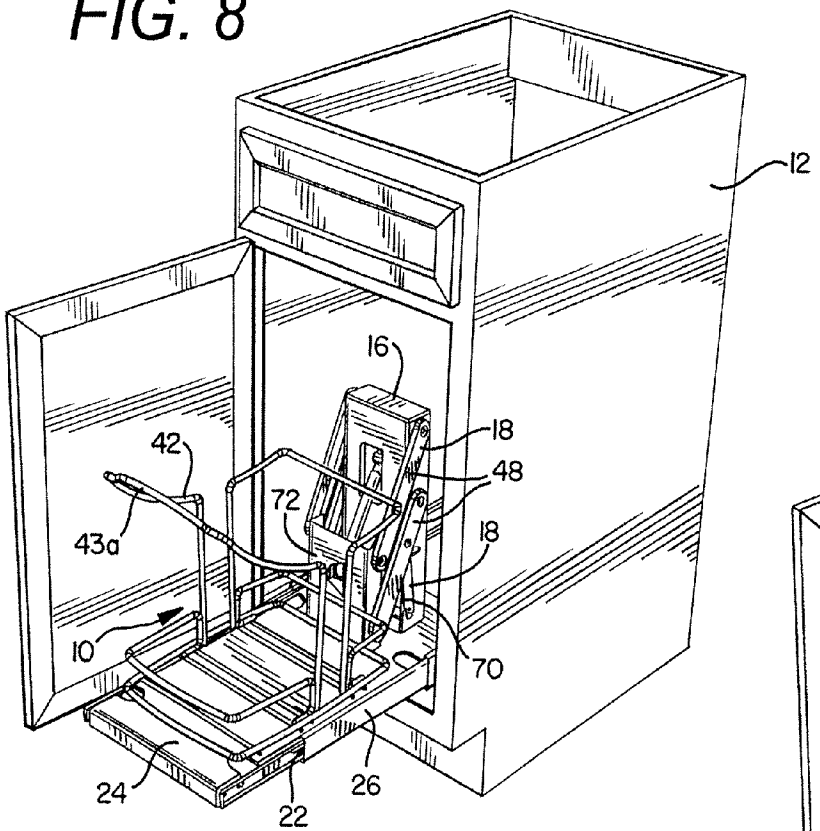
FIG. 8 is a perspective view of the lifting mechanism of FIG. 1, shown installed in a cabinet and in a lowered position.
Figure 15:
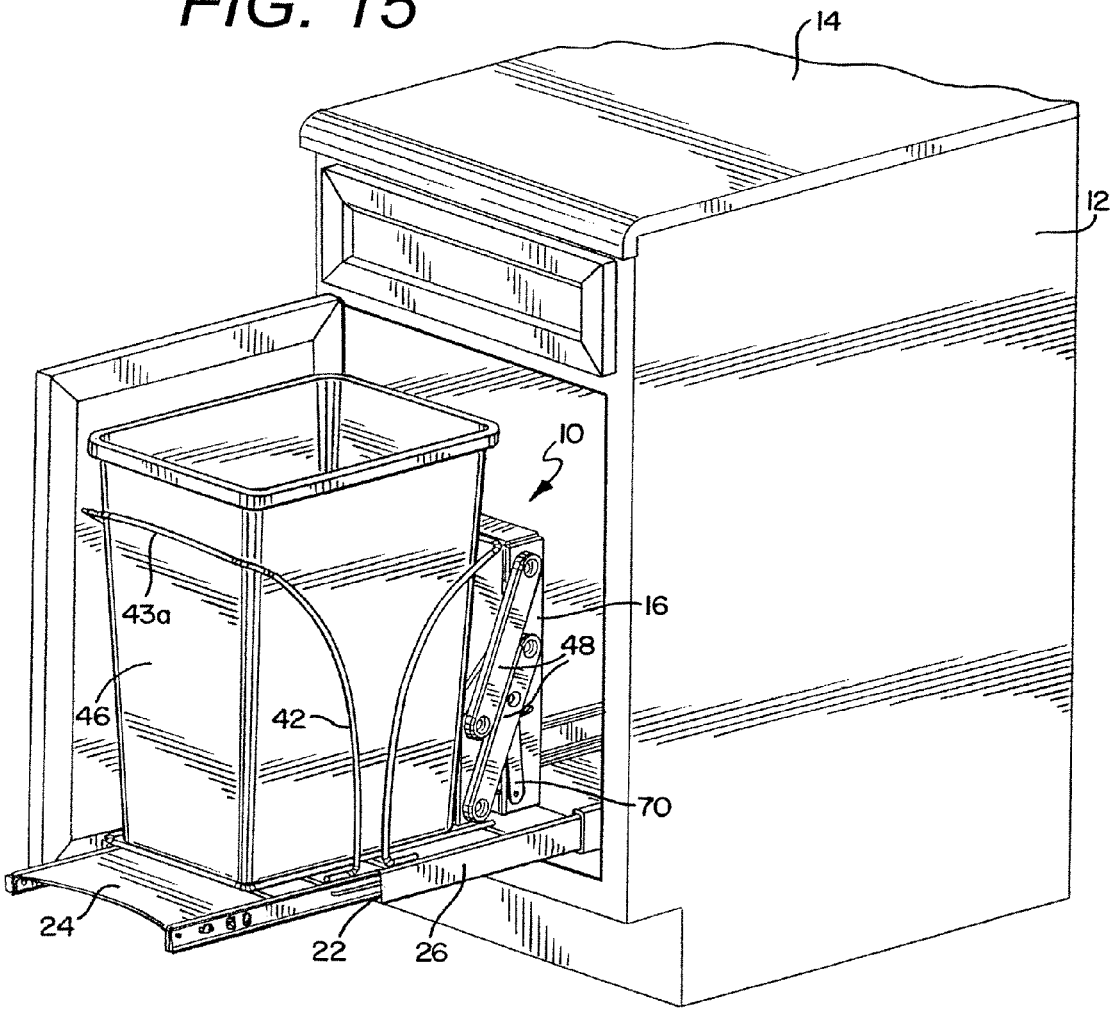
FIG. 15 is a perspective view of the lifting mechanism of FIG. 1, shown with a storage bin and installed in a cabinet in an extended position.
Figure 16:
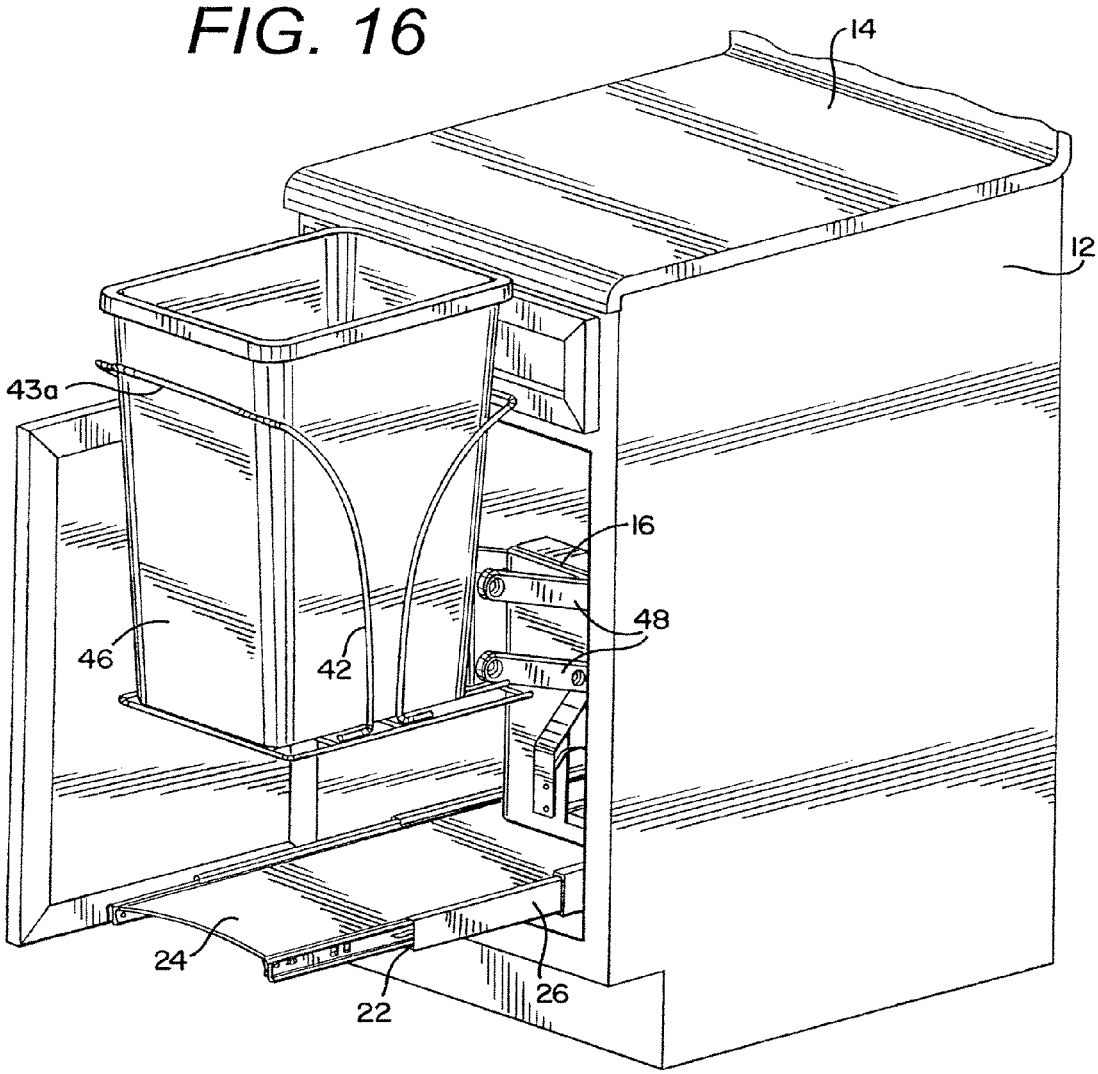
FIG. 16 is a perspective view of the lifting mechanism of FIG. 1, shown with a storage bin and installed in a cabinet in raised and latched position.

FIGS. 8, 10, and 15 show the storage bin 46 in a lowered, extended position. Thus, the moveable member 18 is in the lowered position. When the storage bin 46 is in a lowered, extended position, the spring 58 remains disengaged from the pin 54 of the moveable member 18. At this time, the pin 54 is located in the vertical portion 34 of the slot 32. A user can move the moveable member 18 from the lowered position to the raised position such as by lifting on the handle 43*a*. The arms 48 will pivot upwardly and the link 70 will travel generally upwardly. Accordingly, the pin 54 will move upwardly in the vertical portion of the slot 32. As the storage bin 46 is further moved from the lowered position to a raised position, the pin 54 will engage the spring 58, as shown in FIG. 13. As the pin 54 engages the spring 58, the spring 58 will contract and bias the pin 54. As the moveable member 18, and thus the support member 20 and the storage bin 46 is further raised, the spring 58, will ultimately push the pin 54 into the horizontal portion 36 of the slot 32. Once the pin 54 is received in the horizontal portion 36 of the slot 32, the moveable member 18 is in the fully raised position and is locked into position to define a latched position. In this configuration, the support member 20 is also in a raised position. The components of the lifting mechanism 10 are dimensioned such that when the storage bin 46 is in a raised position, the storage bin 46 is generally adjacent to the cabinet 12. After the storage bin 46 is locked into position, the spring 58 disengages from the pin 54 and returns to its starting or neutral position. Referring to FIGS. 9, 11-12, 14, and 16, the moveable member 18 is in its second position or raised position wherein the arms are fully pivoted upwardly. In the raised position, the support member 20, and therefore the lifting mechanism 10 are in the raised position. When the lifting mechanism 10 is in a completely raised position, the top of the storage bin 46 is preferably proximate the countertop 14 at a more comfortable height, so that a user avoids having to bend down to throw items away. As can be appreciated from FIGS. 15 and 16, when the sliding mechanism 22 is in the fully extended position, the support member 20 is positioned outside of the cabinet 12 and spaced away from the countertop 14. If the moveable member 20 is moved to the raised position, the top of the storage bin 46 will proximate the height of the countertop 14. Depending on the dimensions of the lifting mechanism 10, the storage bin 46 may be spaced away from the countertop 14. As shown in FIG. 16, while the moveable member 18 is raised in a latched position, the sliding mechanism 22 can be partially retracted wherein the edge of the top portion of the storage bin 46 is in a contacting relation or even abutting relation to an edge of the countertop 14.

In order to lower the storage bin 46, a user, via the handle 43*a*, slightly raises the storage bin 46 and pulls outwardly on the support member 20. This causes the pin 54 to release and move to the right of the horizontal portion 36 of the slot 32. As a user lowers the storage bin 46, the pin 54 and link 70 will descend down the vertical portion 34 of the slot 32. As the pin 54 continues to be lowered in the slot 32, the pin 54 engages the spring 58 until the pin 54 passes the spring 58. Once the lifting mechanism 10 has returned back to a lowered position, it can slide back into the cabinet into a retracted position for storage.

Thus, the storage bin 46 can be repeatedly raised, lowered, and stored in the cabinet as described above. It is understood that the dimensions of the components may be varied differently according to the size of the cabinets. Furthermore, the moveable members could be dimensioned to raise and lower the support member and storage bin such that the lifting mechanism does not require a sliding mechanism.

While the specific embodiments have been illustrated and described, numerous modifications come to mind without significantly departing from the spirit of the invention, and the scope of protection is only limited by the scope of the accompanying claims.

What is claimed is:

1. A lifting mechanism in a cabinet having a countertop, the lifting mechanism comprising:

a base adapted to be supported in the cabinet, wherein the base is supported on a carrier and substantially perpendicular to the carrier, the base having a slot with a horizontal portion and a vertical portion;

a moveable member operably connected to the base;

a support member connected to the moveable member, wherein the support member is movable between a raised position and a lowered position; and a storage bin supported by the support member; and wherein the moveable member is dimensioned and moveable between a first position wherein the storage bin is adapted to be positioned within the cabinet, and a second position wherein the storage bin is raised such that the storage bin is adapted to be positioned out of the cabinet and a top of the storage bin is adapted to be positioned proximate the countertop, wherein the movable member has an arm and a link, the arm having one end pivotally connected to the base and another end connected to the support member, and the link has one end that is pivotally connected to the arm and another end that has a pin slidable in the slot, wherein the base also includes a spring connected thereto, the spring biasing the link into the horizontal portion of the slot when the support member is in the raised position to define a latched position, wherein the spring disengages from the link and returns to an unbiased position when the moveable member is in the latched position, and wherein the spring engages the link as the link slides down the vertical portion of the slot when the support member moves to the lowered position.

2. The lifting mechanism of claim 1, wherein the carrier is connected to a sliding mechanism.

3. The lifting mechanism of claim 1, wherein the base has a sidewall.

4. The lifting mechanism of claim 1, wherein the moveable member comprises a plurality of arms pivotally coupled to the base.

5. The lifting mechanism of claim 1, wherein the base is connected to a sliding mechanism that is adapted to be connected to a floor of the cabinet and is moveable between a retracted position and an extended position.

6. The lifting mechanism of claim 5, wherein the sliding mechanism has a plurality of tabs to secure the sliding mechanism to the floor.

7. The lifting mechanism of claim 5, wherein the sliding mechanism and the moveable member cooperatively result in the storage bin being functional in either the extended position or the raised position.

8. The lifting mechanism of claim 1, wherein the support member has a plurality of rails cooperatively defining an opening.

9. The lifting mechanism of claim 1, further comprising a cylinder having a first end connected to the base and a second end connected to the moveable member wherein the cylinder dampens movement of the moveable member from the second position to the first position.

10. The lifting mechanism of claim 1, wherein the storage bin is a wastebasket.

11. A lifting mechanism for an item in a cabinet having a countertop, the lifting mechanism comprising:

a base adapted to be supported in the cabinet, the base having a spring connected thereto and a slot having a generally vertical portion and a generally horizontal portion;

a moveable member moveable between a lowered position and a raised position, the moveable member having an arm having a first end and a second end, the first end of the arm pivotally connected to the base, the moveable member further having a link having a first end pivotally connected to the arm and a second end slideable in the slot; and a support member connected to the second end of the arm, the support member adapted to support the item, wherein when the moveable member is in the lowered position, the support member is adapted to be positioned in the cabinet, wherein as the arm moves from the lowered position, the link slides along the vertical portion of the slot and the spring biases the link into the horizontal portion of the slot to define a latched position wherein the spring disengages from the link and returns to an unbiased position when the moveable member is in the latched position, and wherein the arm is in the raised position of the moveable member placing the support member in a raised position and out of the cabinet wherein the item is adapted to be positioned out of the cabinet.

12. The lifting mechanism of claim 11 further comprising a sliding mechanism connected to the base, the sliding mechanism adapted to be connected to a floor of the cabinet, the sliding mechanism moveable between a retracted position and an extended position, wherein the support member is adapted to be positioned in the cabinet when the sliding mechanism is in the retracted position and wherein the support member is adapted to be positioned out of the cabinet when the sliding mechanism is in the extended position.

13. The lifting mechanism of claim 11 further comprising a cylinder having a first end connected to the base and a second end connected to the moveable member, wherein the cylinder dampens movement of the moveable member from the raised position to the lowered position.

14. The lifting mechanism of claim 11 wherein the support member has a plurality of bars cooperatively defining an opening adapted to received the item.

15. A lifting mechanism for a storage bin in a cabinet having a countertop, the lifting mechanism comprising:

a sliding mechanism adapted to be connected to a floor of the cabinet, the sliding mechanism moveable between a retracted position and an extended position;

a base connected to the sliding mechanism, the base having a spring connected thereto and a slot having a generally vertical portion and a generally horizontal portion, wherein the base is supported on a carrier and substantially perpendicular to the carrier;

a moveable member moveable between a lowered position and a raised position, the moveable member having an arm having a first end and a second end, the first end of the arm pivotally connected to the base, the moveable member further having a link having a first end pivotally connected to the arm and a second end slideable in the slot; and a support member connected to the second end of the arm, the support member having a plurality of rails cooperatively defining an opening adapted to receive the storage bin through the opening, wherein when the sliding mechanism is in the retracted position, the support member is adapted to be positioned within the cabinet, and wherein when the sliding mechanism is in the extended position, the support member is adapted to positioned out of the cabinet, wherein as the arm moves from the lowered position, the link slides along the vertical portion of the slot and the spring biases the link into the horizontal portion of the slot to define a latched position wherein the spring disengages from the link and returns to an unbiased position when the moveable member is in the latched position, and wherein the arm is in the raised position of the moveable member placing the support member in a raised position, such that a top of the storage bin adapted to be supported by the support member is adapted to be positioned proximate the countertop.

16. The lifting mechanism of claim 15 further comprising a cylinder having a first end connected to the base and a second end connected to the moveable member, wherein the cylinder dampens movement of the moveable member from the raised position to the lowered position.

* * * * *